US009478904B2

(12) United States Patent
Ferry

(10) Patent No.: US 9,478,904 B2
(45) Date of Patent: Oct. 25, 2016

(54) PUSH-PULL COUPLING LOCKING CONNECTOR

(71) Applicant: ELEKTRON TECHNOLOGY UK LIMITED, Cambridge, Cambridgeshire (GB)

(72) Inventor: David Ian Ferry, Essex (GB)

(73) Assignee: Elektron Technology UK Limited (GB)

( * ) Notice: Subject to any disclaimer, the term of this patent is extended or adjusted under 35 U.S.C. 154(b) by 7 days.

(21) Appl. No.: 14/398,056

(22) PCT Filed: May 3, 2013

(86) PCT No.: PCT/GB2013/051155
§ 371 (c)(1),
(2) Date: Oct. 30, 2014

(87) PCT Pub. No.: WO2013/167878
PCT Pub. Date: Nov. 14, 2013

(65) Prior Publication Data

US 2015/0155654 A1 Jun. 4, 2015

(30) Foreign Application Priority Data

May 8, 2012 (GB) ..... 1207991.9

(51) Int. Cl.
*H01R 13/62* (2006.01)
*H01R 13/627* (2006.01)

(52) U.S. Cl.
CPC ..... *H01R 13/6271* (2013.01)

(58) Field of Classification Search
CPC ..... H01R 13/6271; H01R 13/627
USPC ..... 439/370
See application file for complete search history.

(56) References Cited

U.S. PATENT DOCUMENTS

| | | | | |
|---|---|---|---|---|
| 5,029,904 | A | 7/1991 | Hunt | |
| 5,529,348 | A * | 6/1996 | Wasserman | F16L 19/0231 285/288.6 |
| 5,637,010 | A | 6/1997 | Jost et al. | |
| 6,093,043 | A | 7/2000 | Gray et al. | |
| 7,722,379 | B2 | 5/2010 | Yang et al. | |
| 2009/0130887 | A1 | 5/2009 | Guilbert et al. | |
| 2009/0304334 | A1 | 12/2009 | Robert | |
| 2011/0053397 | A1 | 3/2011 | Fuchs | |
| 2011/0269331 | A1 | 11/2011 | Saber | |

FOREIGN PATENT DOCUMENTS

| | | |
|---|---|---|
| EP | 0 206 582 | 12/1986 |
| WO | WO 2008/059490 A1 | 5/2008 |
| WO | WO 2009/108480 A1 | 9/2009 |

OTHER PUBLICATIONS

UKIPO Search Report for corresponding GB1207991.9, completed Nov. 21, 2012.
International Search Report for corresponding PCT/GB2013/051155, completed Jul. 3, 2013.
Examination Report for Application No. GB1207991.9, mailed Feb. 6, 2015, pp. 1-2.

* cited by examiner

*Primary Examiner* — Javaid Nasri
(74) *Attorney, Agent, or Firm* — Tarolli, Sundheim, Covell & Tummino LLP

(57) ABSTRACT

A locking connector is provided that comprises first and second connector parts configured to releasably engage with one another along a longitudinal axis of the connector. The first connector part comprises a plurality of circumferentially disposed resiliently bendable latching fingers each finger attached at one end to the first connector and having an ear at an opposite end. The second connector part comprises one or more recesses to receive the ears of the fingers. The connector comprises a locking ring, moveable along the axis such that in a first position the ears engage in the recesses to lock the connector parts together, and in a second position the ears are free to move radially outwards to enable the connector parts to be separated.

19 Claims, 7 Drawing Sheets

PUSH-PULL COUPLING LOCKING CONNECTOR

RELATED APPLICATIONS

The present invention is a U.S. National Stage under 35 USC 371 patent application, claiming priority to Serial No. PCT/GB2013/051155, filed on 3 May 2013; which claims priority from GB 1207991.9, filed 8 May 2012, the entirety of both of which are incorporated herein by reference.

FIELD OF THE INVENTION

This invention relates to a push-pull coupling connector mechanism with a user operable lock.

BACKGROUND TO THE INVENTION

Broadly speaking embodiments of the invention relate to connectors of the type which have a push-pull coupling in which the two parts latch together, and in which a disengaging sleeve provides a quick-release function. In more detail, typically a ring of teeth or the like protrude from the inner circumference of a female part of the coupling and engage a groove on the external circumference of a male part. A sleeve moves longitudinally on the female part and this provides clearance for the teeth to move slightly radially outwards during coupling of the connector parts. During de-coupling of the connector parts the sleeve retracts the teeth on the female part from the groove from the male part. The sleeve is on the outside of the coupled connector so that the action of pulling the connectors apart moves the sleeve longitudinally, thus releasing the teeth and enabling the male and female parts of the connector to be separated. Such a quick fit connector is typically provided for joining hosepipes and the like; example are described in EP0206582A and WO2008/059490.

Further background prior art can be found in US2011/269331; US2009/130887; U.S. Pat. No. 6,093,043; U.S. Pat. No. 5,637,010; U.S. Pat. No. 7,722,379; US2009/304334; WO2009/108480 and GB883449.

GB1,167,680 generally relates to a quickly-releasable hose-connector of spigot-and-socket type, where a series of radially-moving pawls in the socket member engage with a groove in the outer surface of the spigot. In one embodiment parts of the connector are rotated to disconnect the connector; in another embodiment they are moved longitudinally with respect to one another. However, in each case a single motion is used for disconnecting.

U.S. Pat. No. 5,029,904 generally relates to a coupling device having a tubular male member and a female sleeve member, where latching members on the sleeve member are able to engage with a shoulder of the male member. However, manipulation of a lock ring is required to latch the connector members together, and again a single, rotating action is used to disconnect the connectors.

We will describe improvements to connectors of these and related types, in particular to reduce the risk of accidentally disconnecting a connector.

SUMMARY OF THE INVENTION

According to a first aspect of the invention there is therefore provided a push-pull coupling, quick release locking connector, the connector comprising first and second connector parts configured to releasably mate; said first connector part bearing a plurality of latching extensions disposed around said first connector part; said second connector part having one or more latching surfaces configured to engage with said latching extensions for latching said connector parts together when mated; wherein a said latching extension has a latching formation and is resiliently deformable to retract said latching formation to enable said second connector part to be pushed past said latching formation on mating of said first and second connector part, and wherein, when mated, said latching formation of said first connector part engages with said one or more latching surfaces of said second connector part to inhibit release of said connector parts from one another; wherein said first connector part further comprises a user-operable release control portion having a first, latching position and a second, release position, wherein said release control portion is moveable according to a first degree of freedom (along a longitudinal axis of the connector) between said first, latching position and said second, release position; wherein in said first latching position longitudinal release of said second connector part from said first connector part is inhibited and in said second, release position said release control portion enables longitudinal release of said second connector part from said first connector part; wherein said release control portion has one or more camming surfaces, wherein on movement of said release control portion into said first, locking position said one or more camming surfaces engage said plurality of latching extensions to move said latching extensions to retract said latching formations from engagement with said one or more latching surfaces to enable said second connector part to be withdrawn from said first connector part; and wherein said release control portion has at least one locking formation; and wherein said release control portion is moveable according to a second degree of freedom (in embodiments, rotatable about the axis of the connector), different to said first degree of freedom between a third, locking position and a fourth unlocked position to move said locking formation, such that in said third locking position said locking formation inhibits movement of at least one said latching extension to inhibit selection of said second, release position and retraction of said at least one latching extension from engagement with said latching surface, and such that in said fourth, unlocked position said locking formation is displaced to enable selection of said second, release position and movement of said at least one latching extension to enable retraction of said at least one latching extension from engagement with said latching surface and said first and second connector positions to be released from one another.

Embodiments of the connector, as well as latching with a quick-release function, enable the connector to be locked in the latched-together configuration, thus providing enhanced security and reliability. Thus in embodiments, the connector may be either locked or unlocked when in its first, latching position.

In embodiments of the connector the latching surface comprises a recess, groove or other indentation in the second connector part, although alternatively a circumferential step or similar formation will serve to latch the connector parts together. In embodiments the latching extensions comprise fingers disposed around an internal perimeter of the first connector part, attached to the first connector part at one end and springy so that they may be resiliently deformed away from the perimeter line and are then biased back towards this location. Preferably such fingers are disposed at substantially regular intervals around the perimeter of the first connector part. In embodiments the latching formation on a finger comprises an ear, lug, clip or other similar formation to engage with the latching surface.

When unlocked the release control portion allows the fingers or other latching extensions to move outwards to enable the connectors to be disengaged, but when locked the release control portion inhibits movement of the latching formations away from their respective latching surface(s), thus locking the connectors together. In embodiments locking is achieved by providing a locking formation, such as a rib or other protrusion, on an internal surface of the release control portion: When the rib/protrusion or the like is aligned with a finger the finger is inhibited from moving outwards to release the latching formation from its latching surface. Although in principle only one such locking formation is needed, in embodiments each finger has a respective locking formation on the release control portion. In embodiments the interior surface of the release control portion is moveable laterally with respect to a latching extension so as to move the locking formations so that they either allow outward motion of the fingers (unlocked) or interfere with an inhibit such outward motion (locked). In embodiments this is conveniently achieved by providing first and second connector parts with circular cross-sections and providing a set of circumferentially disposed locking formations on the release control portion: Then the release control portion can be rotated between the third, locking position and fourth, unlocked position.

Nonetheless the skilled person will appreciate, that it is not necessary for the connector to have a circular cross-section and a similar approach may be employed with, for example, a rectangular or square cross-section connector, sliding the release control portion laterally around the perimeter, or across a portion of the perimeter of the first connector, part to move between the third and fourth, locking/unlocked positions.

The skilled person will further appreciate that although, in embodiments, the latching extension comprise fingers with inwardly directed ears or teeth to engage a groove in the second connector part, such an arrangement may be effectively turned inside out such that the teeth on the fingers are directed outwards away from an axis of the connector and engage a groove or other latching surface on an interior surface of the second connector part. In such an arrangement to facilitate quick release of the connector parts, although one end of the release control portion near the free ends of the fingers may be internal, a user operable region of the release control portion may be accessible further along the longitudinal length of the connector. The skilled person will also appreciate that it is immaterial which of the first and second connector parts is labelled male and which is labelled female.

Some preferred embodiments of the connector include a further improvement in, and simplification of, the design. The release control portion of the connector is longitudinally biased in a mating direction of the first and second connector parts. In this way when the parts are coupled the release control portion is biased to avoid unlocking the latched parts, absent user force pulling the coupled parts apart. In embodiments this bias is provided by the one or more camming surfaces of the release control portion: the first connector part is arranged so that a portion of the latching extension (finger) bears against a sloping surface such that any resilient deformation of the finger outwards away from the axis of the connector (or inwards in the case of an 'inverted arrangement') results in an additional longitudinal force on the release control portion which pushes the release control portion towards its first, latching position. This can be achieved by arranging the one or more camming surfaces to have normals directed towards the longitudinal axis (or axis plane) of the connector. In embodiments the one or more camming surfaces are defined by an internal chamfer on the release control portion—for example the release control portion may have a lip at one end defining a partial or complete ring-shaped recess around one end of the release control portion. An interior edge of this lip may comprise a tapered surface tapering to a smaller dimension/diameter in a direction away from a mating region of the connector parts. This may either be a single, continuous ring-shaped tapered surface or a set of tapered surface portions disposed circumferentially or along a perimeter of the release control portion. Such an arrangement biases the release control portion towards the mating region of the connector, keeping the connected parts locked together absent external longitudinal force on the release control portion. In embodiments the majority, and in some preferred embodiments substantially all, the bias of the release control portion towards the mating region of the connector (longitudinal force) is provided by the one or more camming surfaces operating in conjunction with the latching extensions/fingers—and thus the connector may lack any additional spring biasing the release control portion in this direction.

Thus in a related aspect the invention provides a push-pull coupling, quick release locking connector, the connector comprising first and second connector parts configured to releasably mate; said first connector part bearing a plurality of latching extensions disposed around of said first connector part; said second connector part having one or more latching surfaces configured to engage with said latching extensions for latching said connector parts together when mated; wherein a said latching extension has a latching formation and is resiliently deformable to retract said latching formation to enable said second connector part to be pushed past said latching formation on mating of said first and second connector part, and wherein, when mated, said latching formation of said first connector part engages with said one or more latching surfaces of said second connector part to inhibit release of said connector parts from one another; wherein said first connector part further comprises a user-operable release control portion having a first, latching position and a second, release position, wherein said release control portion is moveable according to a first degree of freedom between said first, latching position and said second, release position; wherein in said first latching position longitudinal release of said second connector part from said first connector part is inhibited and in said second, release position said release control portion enables longitudinal release of said second connector part from said first connector part; wherein said release control portion has one or more camming surfaces, wherein on movement of said release control portion into said first, locking position said one or more camming surfaces engage said plurality of latching extensions to move said latching extensions to retract said the latching formations from engagement with said one or more latching surfaces to enable said second connector part to be withdrawn from said first connector part; and wherein said first degree of freedom comprises longitudinal motion of said release control portion along an axis of said connector; wherein said release control portion is configured to fit around said latching extensions; wherein said one or more camming surfaces comprise one or more sloping surfaces having normals directed towards said axis of said connector such that longitudinal motion of said release control portion parallel to said axis moves said one or more sloping surfaces to pull said plurality of latching extensions to retract said latching formations from engagement with said one or more latching surfaces, wherein said release control portion is longitudinally biased towards said first locking position, and wherein a portion of a said latching extension bears against a said sloping surface such that resilient deformation of a said latching formation by said sloping surface on said longitudinal motion of said release control portion results in a longitudinal force on said release control portion to bias said release control portion towards said first, locking position.

The invention further provides a locking connector comprising first and second connector parts configured to releasably engage with one another along a longitudinal axis of the connector, wherein: said first connector part comprises a plurality of circumferentially disposed resiliently bendable latching fingers each finger being attached at one end to said first connector and having an ear towards an opposite end; said second connector part comprises one or more recesses to receive said ears of said fingers; wherein said latching fingers of said first connector part retract to enable said second connector part to be pushed past said ears of said latching fingers on mating of said first and second part; said first connector part further comprises a locking ring, moveable along said longitudinal axis such that in a first longitudinal position said ears engage in said one or more recesses to lock said first and second connector parts together, and in a second longitudinal position said ears are free to move radially outwards to enable said first and second connector parts to be separated; and wherein an interior surface of said locking ring has one or more raised stops such that in a first, locked rotational position said one or more stops inhibit one or both of movement of a said ear radially outwards and movement of said locking ring into said second longitudinal position, and in a second, unlocked rotational position said ears are free to move radially outwards to enable said first and second connector parts to be separated.

The invention still further provides a locking connector comprising first and second connector parts configured to releasably engage with one another along a longitudinal axis of the connector, wherein: said first connector part comprises a plurality of circumferentially disposed resiliently bendable latching fingers each finger being attached at one end to said first connector and having an ear towards an opposite end; said second connector part comprises one or more recesses to receive said ears of said fingers; a locking ring, moveable along said longitudinal axis such that in a first longitudinal position said ears engage in said one or more recesses to lock said first and second connector parts together, and in a second longitudinal position said ears are free to move radially outwards to enable said first and second connector parts to be separated; and wherein an inward resilient bias of latching fingers on said camming surface provides a longitudinal bias of said locking ring towards said first longitudinal position, in particular wherein said locking ring lacks any additional bias towards said first longitudinal position.

In embodiments of the above described connector preferably a detent is provided for the locking mechanism. Thus the release control portion may be provided with a detent for movement of the release control portion between the third and fourth positions. Similarly the locking ring/sleeve may be provided with a detent for movement between its first and second, locked and unlocked rotational positions. Such detent may comprise, for example, a bump and a pair of indentations or the like. This assists in reducing the risk of the connector accidentally moving to its unlockable state with vibration and the like.

The invention further provides a push-pull locking connector, the connector having mating first and second connector parts and incorporating a latching mechanism comprising a set of fingers on said first connector part, a said finger having a clip at one end which engages with a groove on said second connector part when said second connector is pushed past said clips of said fingers and a sleeve which, when pulled back, moves said clips on said fingers out of said groove, wherein said connector further comprises a lock mechanism comprising a set of formations on said sleeve, wherein said lock mechanism is moveable between a locked position in which said formations lie behind said fingers to inhibit movement of said clips out of said groove and an unlocked position in which said formations are moved out of a path of motion of said fingers.

The invention also provides, separately, a first connector part as recited in any of the above described aspects of the invention.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Embodiments of the connectors we describe may be fabricated in either plastic or metal, among other materials. In the following description references are to either except where otherwise stated.

Figure 1A:
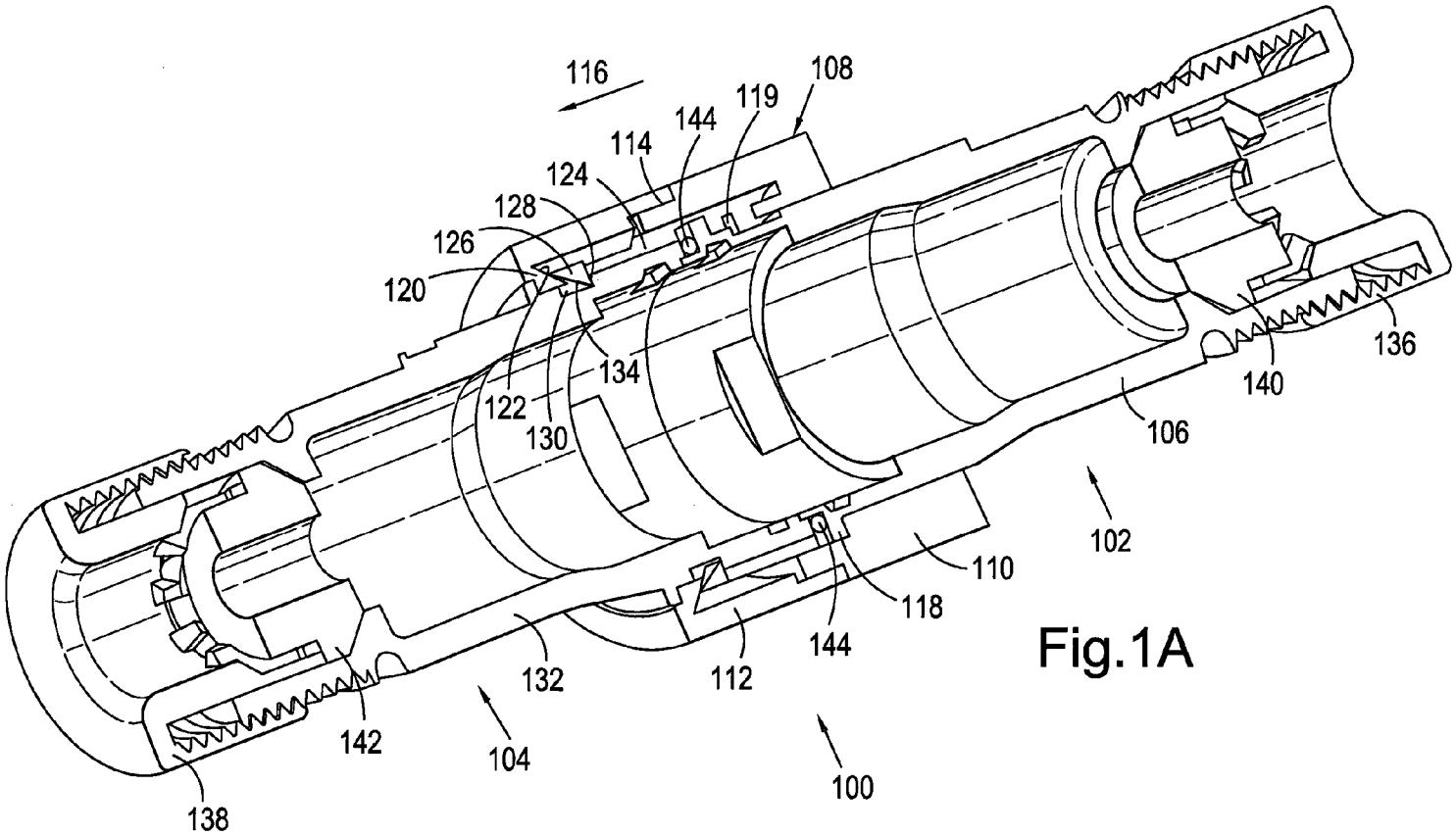
FIG. 1*a* to 1*c* show a 3D cross-sectional view of mated first and second connector parts of a push-pull coupling quick release locking connector according to an embodiment of the invention fabricated in respectively, plastic and metal; and perspective views of an example electrical connector with and without the user-operable release control portion (disengaging sleeve) in a similar embodiment of the invention.
Figure 1B:
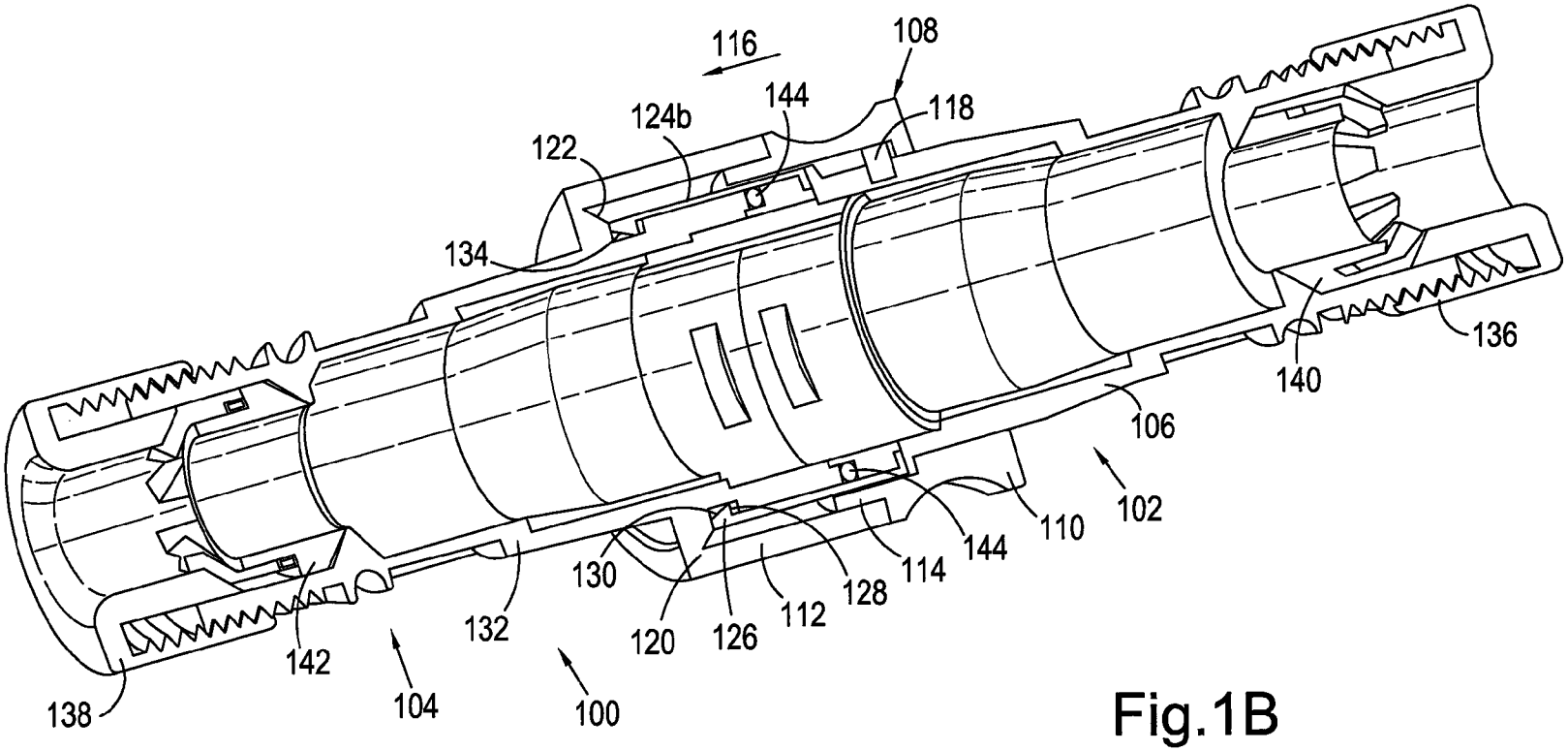
Figure 1C:
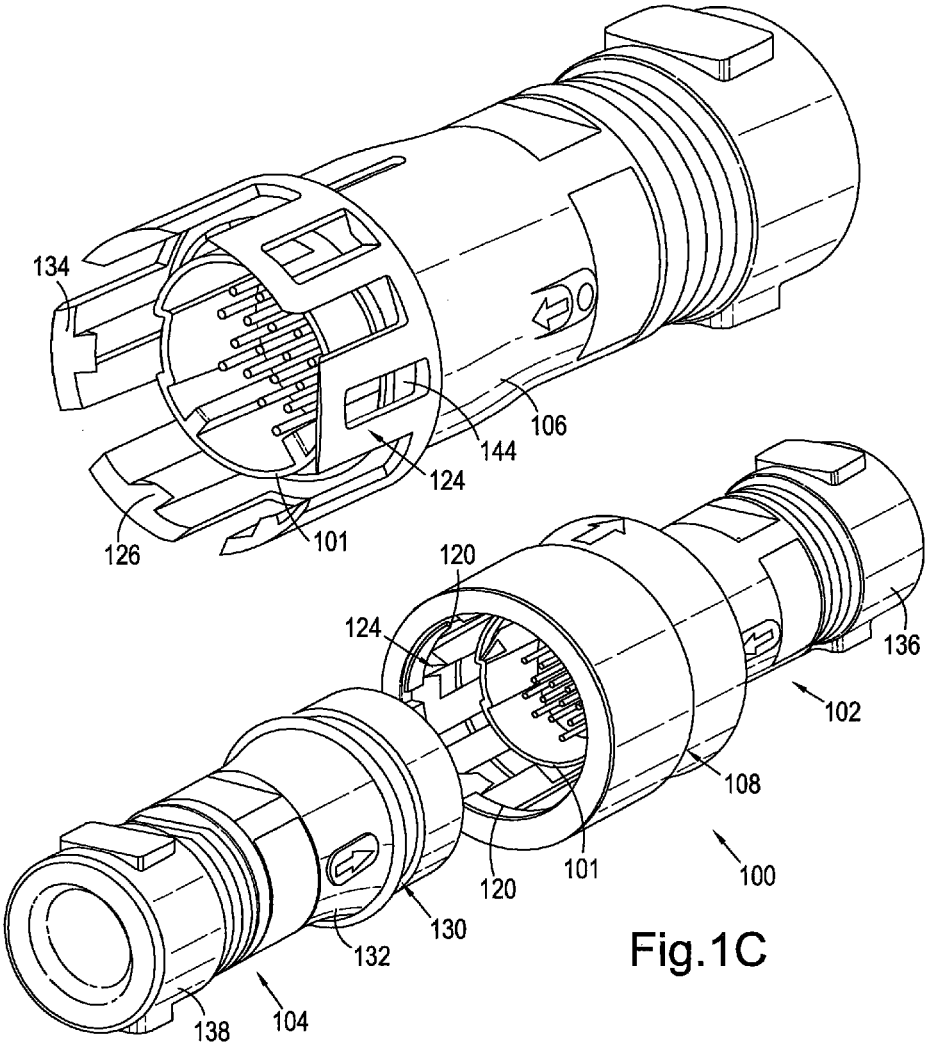
Figure 2A:
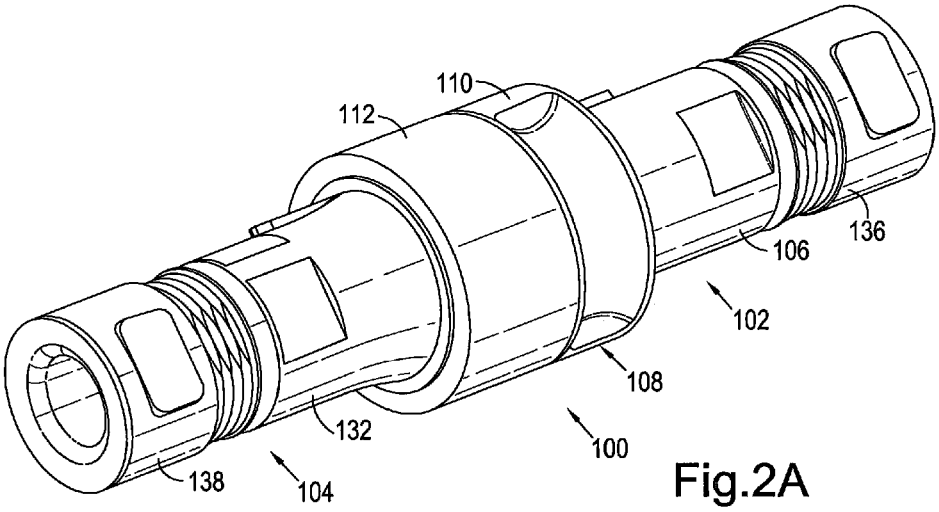
FIGS. 2*a* and 2*b* show 3D perspective views of the connectors of FIGS. 1*a* and 1*b* respectively.
Figure 2B:
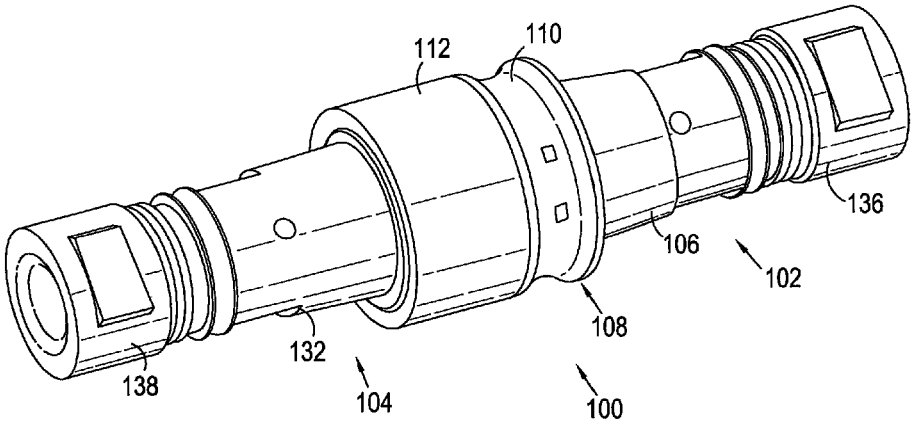
Figure 3A:
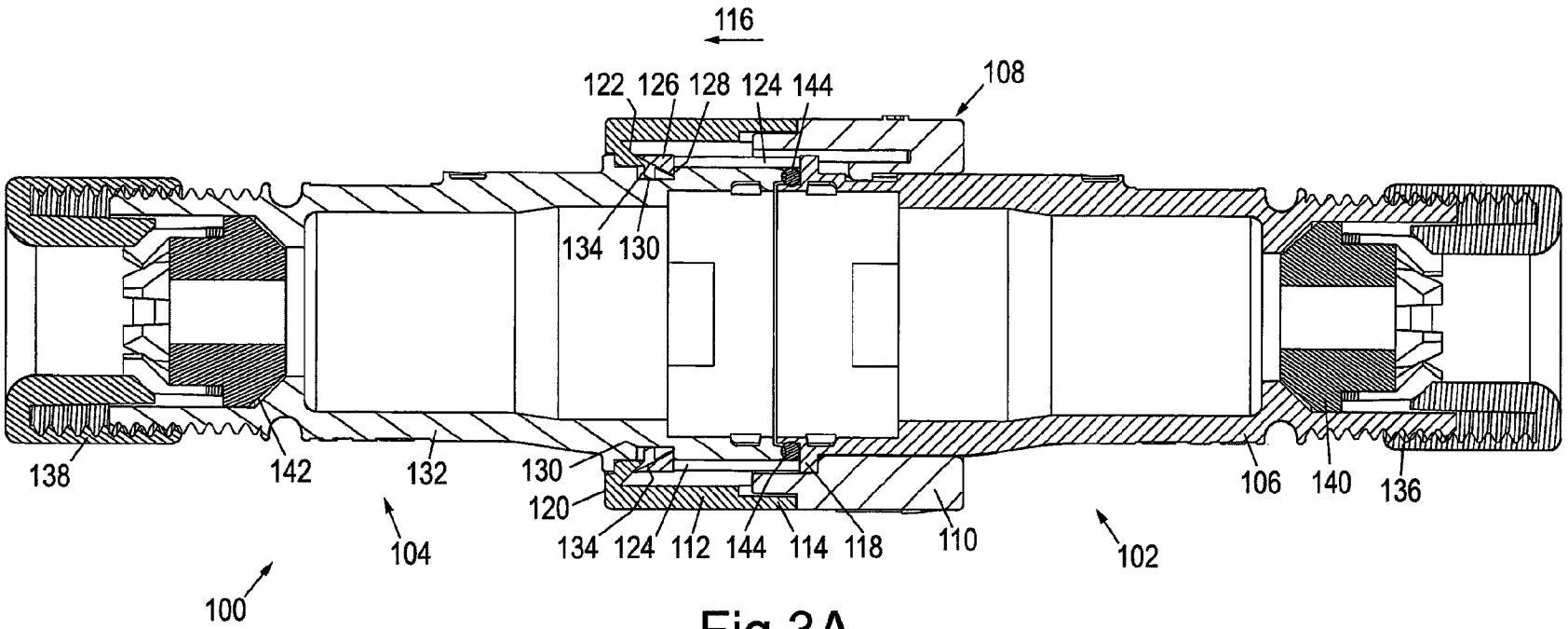
FIGS. 3*a* and 3*b* show 2D cross-sectional views of the connectors of FIGS. 1*a* and 1*b* respectively.
Figure 3B:
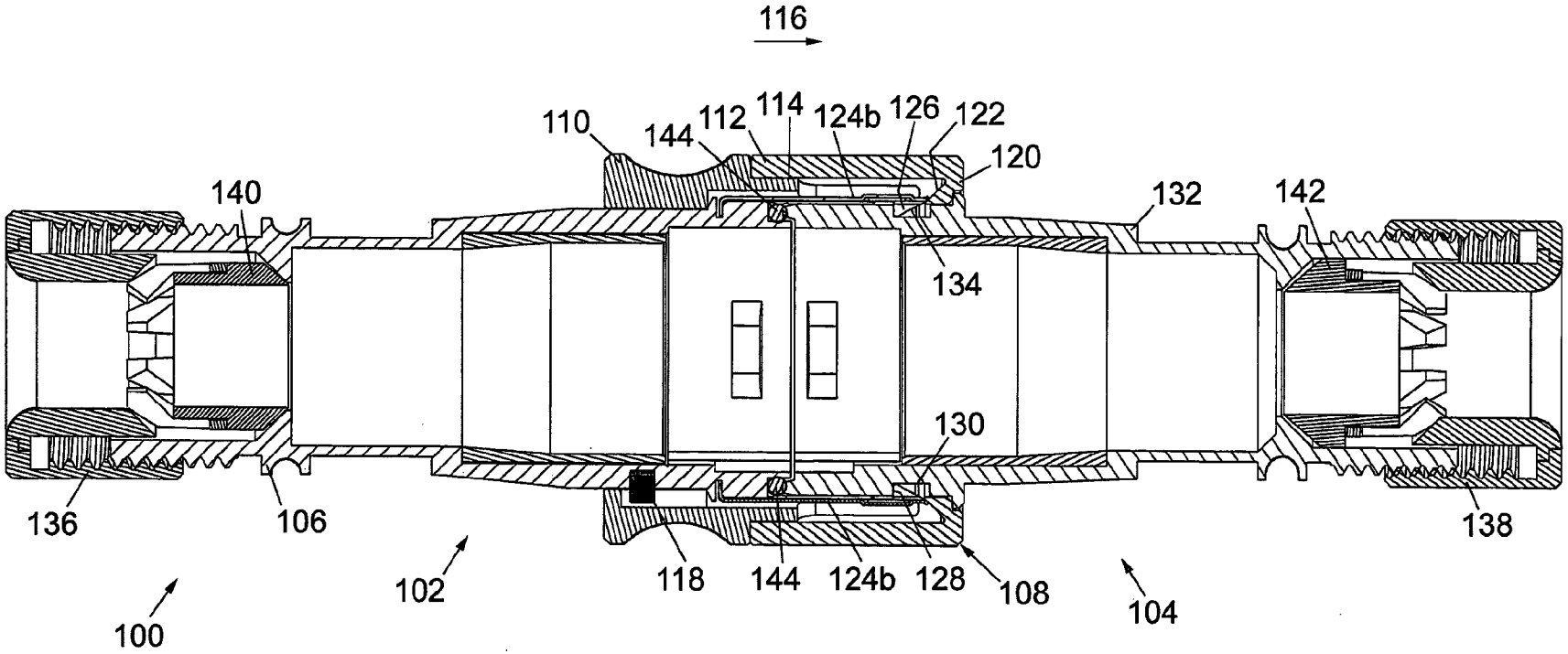

Thus, referring to FIGS. 1 to 3, these show a mated connector 100 according to an embodiment of the invention, comprising a first connector part 102 and a second connector part 104, as illustrated latched together. The first connector part 102 comprises a body 106 providing an aperture for housing, for example, a set of electrical contacts 101 as illustrated in FIG. 1*c*. The first connector part body 106 bears a disengaging sleeve 108 in the form of a ring around the connector body comprising first and second portions 110, 112 screwed together by a reverse thread 114. Alternatively first and second portions 110, 112 may be fixed together using adhesive, ultrasonic welding, snap lock or the like—for example in an embodiment of a plastic connector they press together and are fastened with adhesive. The sleeve 108 is moveable longitudinally along the axis of the connector and is biased in a mating direction 116 of the connectors, against a stop 118. In embodiments the sleeve is clipped into a groove 119 within which it is able to move longitudinally. A distal end of the sleeve in the mating direction is provided with a lip 120 having an internal camming surface 122.

The body 106 of the first connector part is also provided with a plurality of fingers 124 disposed circumferentially around the perimeter of the first connector part. In a plastic connector these may be one-piece moulded with the body 106 of the connector; in a metal connector they may comprise flexible, resilient strips of metal 124*b* attached to the connector body. At the end of a finger there is provided an ear 126, tooth, or similar, having a part or surface 128 which engages with (and latches into) a groove 130 in a body 132 of the second connector part 104. The first and second connector parts are mated using a "push-to-latch" action such that pushing the second connector part into the first connector part results in the ear 126 of the flexible fingers 124 becoming latched into the groove 130 of the second connector part. No further action is necessary to latch the two connectors together. The ear 126 (and/or finger 124) also has a camming surface 134 which matches surface 122 of the sleeve 108. In this way, motion of the sleeve 108 against the mating direction pulls ear 126 from groove 130 for each finger, thus releasing the first connector part from the second connector part and enabling the connector parts to be disengaged from one another. Because the sleeve is on an outer part of the connector a user pulling the connectors apart whilst holding the sleeve will automatically perform this action; optionally sleeve 108 may include a grip on its outer surface for example as illustrated in FIGS. 1*c* and 2.

In embodiments each of the first and second connector parts 102, 104 includes a respective wire clamp 136, 138 and, optionally, a respective rubber grommet 140, 142 to seal against moisture, dirt and the like. Preferably an O-ring 144 is also included between the first and second connector parts, to seal the electrical connections inside.

If the sleeve 108 is moved against the mating direction finger 124 is pushed radially outwards against its inherent resilience, and the action of the two camming surfaces 122 and 134 against one another thus results in a resilient bias of the sleeve 108 along mating direction 116. This keeps the sleeve in the position where the ears lock against the latching surface 128 when the connector parts are engaged without the need for any additional spring.

Figure 4A:
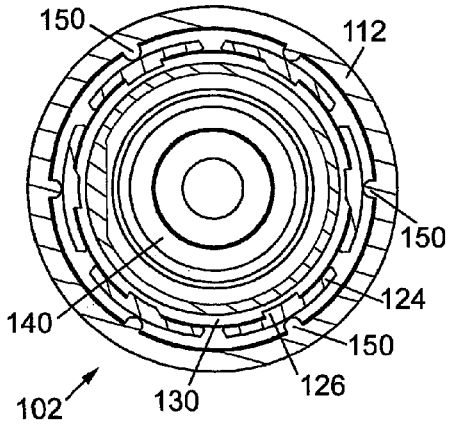
FIGS. 4*a* and 4*b* show 2D lateral cross-sectional views of a first connector part of the connector of FIGS. 1*a* and 1*b* respectively, in a locked position.
Figure 4B:
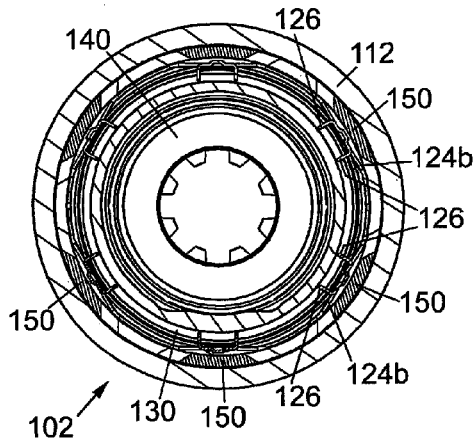
Figure 5A:
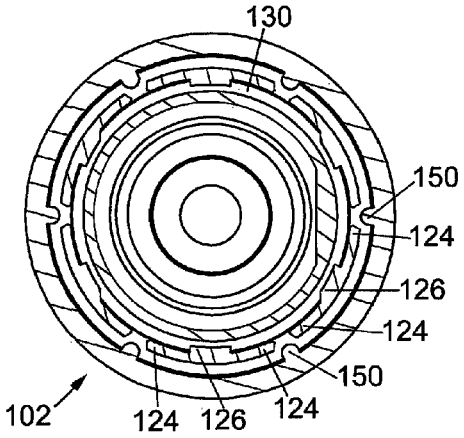
FIGS. 5*a* and 5*b* show lateral cross-sectional views of a first connector part of the connector of FIGS. 1*a* and 1*b* respectively in an unlocked position.
Figure 5B:
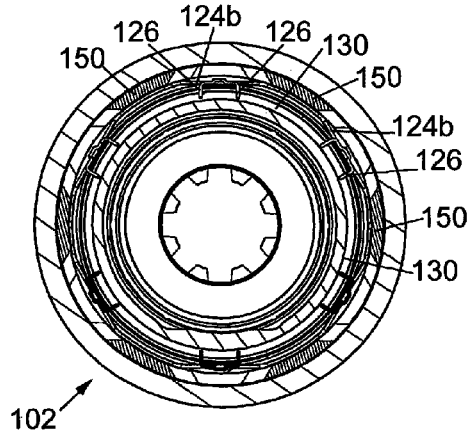

Referring now to FIGS. 4 and 5, these illustrate a set of longitudinal extending ribs 150 provided on an interior surface of the (second portion 112) of the sleeve 108. As can be seen, one rib 150 is provided for each finger. The ring 112 of sleeve 108 is rotatable about the axis of the connector so that the ribs are either located so as to inhibit outward radial movement of the fingers 124, lying against the fingers as shown in FIG. 4, or so that the ribs 150 lie between the fingers 124, as shown in FIG. 5. In this way, when the sleeve 108 is rotated into its locking position not only are the ears of the fingers latched into groove 130, they are prevented from moving out of their latched configuration by ribs 150. The skilled person will appreciate that many variations on the precise form of protuberances 150 are possible. In principle, because rotation of sleeve 108 locks the ears of the fingers in position the engagement of the ears with groove 130 need not be as positive as with an arrangement in which this latching alone is relied upon to hold the connectors together. It is nonetheless preferable that the ears engage positively with their corresponding latching surface(s) for improved reliability.

Although not shown in the drawings, preferably sleeve 108 includes a detent, such as an indenter, which acts to inhibit undesired movement between the locked and unlocked positions of the ring due to vibration and the like.

Preferred embodiments of the above described connector are used to make electrical connection between conductive contacts. For example embodiments of the connector may be used for a USB (universal serial bus) connection, an Ethernet connection, or some other form of multi-pin connection for example employing removable contact carriers holding either 2, 3, 8, 16 or 22 electrical contacts. Nonetheless the skilled person will appreciate that, in principle, connects of the type described above may also be employed for connections between hoses carrying fluids (liquid or gas).

The illustrated example coupling mechanism employs an arrangement of six latching fingers and incorporates a 30° twist action to lock the mechanism thereby inhibiting disengagement of the mating connectors and breaking of the seal. The described embodiment employs an array of six latching fingers, but the skilled person will appreciate that any number of fingers may be employed. Similarly, although a locking ring is straightforward to implement on a cylindrical connector body, in principle other connector shapes may also be employed including, for example, rectangular/square, and oval, connector shapes.

The described embodiment is an in-line connector but the skilled person will appreciate that other configurations of the mechanism may also be employed, for example configurations in which one or both of the connector parts are chassis-mounted.

Broadly speaking we have described a quick-release locking connector including a latching mechanism which disengages by pulling back on a coupling ring, forcing an array of latching fingers outwards, moving ears or clips on the ends of the fingers out of a groove in the mating connector body. A twist-lock mechanism is provided which works by moving ribs or similar protuberances on the coupling ring from being in-between the fingers to being behind the fingers to inhibit their outward movement, and hence lock the connector parts together.

In summary, we have described embodiments of a connector that advantageously combines two (independent) mechanisms. Firstly, a push/pull action to latch the connectors together, that is: a) push the connectors to latch ("push-to-latch"); and b) pull the outer sleeve of one connector back and (independently) pull the connectors apart to release. Here, the spring force on the clamps/fingers is provided by the clamps/fingers themselves, thereby in embodiments requiring no separate spring device. Secondly, a twist lock mechanism ("rotate-to-lock") that prevents the push/pull action from operating.

In embodiments, the connector mechanism is a "two part" mechanism that requires both twisting of the sleeve and pulling back of the sleeve to release the connectors.

The connector is locked by rotating the coupling ring/sleeve. This prevents the fingers from being deflected outward by the pulling action on the coupling ring. The rotation is a separate action to the pulling—the rotation does not involve any longitudinal movement of the connector parts: the connector parts are mated and latched once the two connector halves are pushed together.

In some preferred embodiments, the fingers are turned inwards and are integrally formed with a body part of the connector.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A push-pull coupling, quick release locking connector, the connector comprising first and second connector parts configured to releasably mate;

said first connector part bearing a plurality of latching extensions disposed around said first connector part;

said second connector part having one or more latching surfaces configured to engage with said latching extensions for latching said connector parts together when mated;

wherein at least one of the plurality of latching extensions has a latching formation and is resiliently deformable to retract said latching formation to enable said second connector part to be pushed past said latching formation on mating of said first and second connector part, and wherein, when mated, said latching formation of said first connector part engages with said one or more latching surfaces of said second connector part to inhibit release of said connector parts from one another;

wherein said first connector part further comprises a user-operable release control portion having a first, latching position and a second, release position, wherein said release control portion is moveable along a longitudinal axis of said connector between said first, latching position and said second, release position;

wherein in said first latching position longitudinal release of said second connector part from said first connector part is inhibited and in said second, release position said release control portion enables longitudinal release of said second connector part from said first connector part;

wherein said release control portion has one or more camming surfaces, wherein on movement of said release control portion into said second, release position said one or more camming surfaces engage said plurality of latching extensions to move said latching extensions to retract said latching formations from engagement with said one or more latching surfaces to enable said second connector part to be withdrawn from said first connector part; and wherein said release control portion has at least one locking formation; and wherein said release control portion is rotatable about said axis of said connector, different to said first degree of freedom between a third, locking position and a fourth unlocked position to move said locking formation, such that in said third locking position said locking formation inhibits movement of at least one said latching extension to inhibit selection of said second, release position and retraction of said at least one latching extension from engagement with said latching surface, and such that in said fourth, unlocked position said locking formation is displaced to enable selection of said second, release position and movement of said at least one latching extension to enable retraction of said at least one latching extension from engagement with said latching surface and said first and second connector positions to be released from one another.

2. A connector as claimed in claim 1 wherein said release control portion is configured to fit around said latching extensions, wherein said one or more camming surfaces comprise one or more sloping surfaces having normals directed towards said axis of said connector such that longitudinal motion of said release control portion parallel to said axis moves said one or more sloping surfaces to pull said plurality of latching extensions to retract latching formations from engagement with said one or more latching surfaces, wherein said release control portion is longitudinally biased towards said first locking position, and wherein a portion of a said latching extension bears against a said sloping surface such that resilient deformation of a said latching formation by said sloping surface on said longitudinal motion of said release control portion results in a longitudinal force on said release control portion to bias said release control portion towards said first, locking position.

3. A connector as claimed in claim 1 wherein said release control portion is configured to fit around said latching extensions, and wherein said locking formation comprises a raised formation on an interior surface of said release control portion which, when said release control position is rotated into said third, locking position, interferes with said resilient deformation of said latching extension radially to interfere with retraction of said latching formation on said latching extension.

4. A connector as claimed in claim 1 wherein said latching formation comprises a finger attached at a first end to said first connector part and having an ear towards a second, opposite end;

wherein said release control portion comprises a sleeve on said first connector part having a circumferential internal recess, wherein said circumferential recess defines an internal surface which tapers towards said first end of said finger and define said one or more camming surfaces, and wherein said ears of said latching extensions extend into said circumferential internal recess such that longitudinal movement of said release control portion towards said first end of said finger pulls said ear away from said circumferential internal recess.

5. A connector as claimed in claim 4 wherein said finger has a tapered surface at said second opposite end, tapering in a direction to match said taper of said internal surface.

6. A connector as claimed in claim 5 wherein said tapered surface of said finger is a surface of said ear.

7. A connector as claimed in claim 4 wherein engagement of said second opposite end of said finger against said internal surface of said recess is sufficient to resiliently bias said release control portion longitudinally away from said first end of said finger up to a longitudinal stop on said first connector part.

8. The connector as recited in claim 1, wherein said release control portion is configured to fit around said latching extensions; wherein said one or more camming surfaces comprise one or more sloping surfaces having normals directed towards said axis of said connector such that longitudinal motion of said release control portion parallel to said axis moves said one or more sloping surfaces to pull said plurality of latching extensions to retract said latching formations from engagement with said one or more latching surfaces, wherein said release control portion is longitudinally biased towards said first locking position, and wherein a portion of a said latching extension bears against a said sloping surface such that resilient deformation of a said latching formation by said sloping surface on said longitudinal motion of said release control portion results in a longitudinal force on said release control portion to bias said release control portion towards said first, locking position.

9. A first connector part as recited in claim 8 and further comprising a multipin electrical connector element within said first connector part.

10. A connector or first connector part as recited in claim 1 further comprising mating male and female multipin electrical connector elements within said first and second connector parts.

11. A locking connector comprising first and second connector parts configured to releasably engage with one another along a longitudinal axis of the connector, wherein:

said first connector part comprises a plurality of circumferentially disposed resiliently bendable latching fingers each finger being attached at one end to said first connector and having an ear towards an opposite end;

said second connector part comprises one or more recesses to receive said ears of said fingers;

a locking ring, rotatable about said longitudinal axis such that in a locked position said ears engage in said one or more recesses to lock said first and second connector parts together, and in an unlocked position said ears are free to move radially outwards to enable said first and second connector parts to be separated; and wherein an inward resilient bias of the latching fingers on one or more camming surface of said locking ring provides a longitudinal bias of said locking ring towards said first longitudinal position, in particular wherein said locking ring lacks any additional bias towards said first longitudinal position.

12. The connector as recited in claim 11 wherein the first connector part comprises said locking ring and said ears are for mating with one or more recesses of a second connector part.

13. A first connector part as recited in claim 12 and further comprising a multipin electrical connector element within said first connector part.

14. A connector or first connector part as recited in claim 11 further comprising mating male and female multipin electrical connector elements within said first and second connector parts.

15. A push-pull locking connector, the connector having mating first and second connector parts and incorporating a latching mechanism comprising a set of fingers on said first connector part, at least one of said fingers having a clip at one end which engages with a groove on said second connector part when said second connector part is pushed past said at least one clip of said fingers, and a sleeve which, when pulled back, moves said at least one clips on said fingers out of said groove, wherein said connector further comprises a lock mechanism comprising a set of formations on said sleeve, wherein said lock mechanism is rotatable about a longitudinal axis of said connector between a locked position in which said formations lie behind said fingers to inhibit movement of said clips out of said groove and an unlocked position in which said formations are moved out of a path of motion of said fingers.

16. A push-pull locking connector as claimed in claim 15 wherein said sleeve comprises a circular ring and said lock mechanism comprises a twist-lock mechanism.

17. A push-pull locking connector as claimed in claim 15 wherein said latching mechanism is biased forward substantially solely by action of said fingers on said sleeve.

18. The push-pull connector as recited in claim 15 wherein said first connector part comprising said sleeve.

19. A connector or first connector part as recited in claim 15 further comprising mating male and female multipin electrical connector elements within said first and second connector parts.

* * * * *